US006957739B1

(12) United States Patent
Stephenson

(10) Patent No.: US 6,957,739 B1
(45) Date of Patent: Oct. 25, 2005

(54) CONTAINER SYSTEM FOR STORING AND PRESENTING CRAFT MATERIALS

(76) Inventor: Barbara Stephenson, 6903 S.V.L. Box, Victorville, CA (US) 92392

( * ) Notice: Subject to any disclaimer, the term of this patent is extended or adjusted under 35 U.S.C. 154(b) by 0 days.

(21) Appl. No.: 10/782,070

(22) Filed: Feb. 19, 2004

(51) Int. Cl.[7] ..... B65D 71/00
(52) U.S. Cl. ..... 206/575; 206/443; 206/561
(58) Field of Search ..... 206/443, 575, 206/561; 220/507, 528, 529, 534, 662, 665, 220/602

(56) References Cited

U.S. PATENT DOCUMENTS 231,478 A 8/1880 Curry
2,125,856 A * 8/1938 De Witt ..... 220/532
2,221,024 A * 11/1940 Hood ..... 220/533
3,249,392 A 5/1966 Berman
3,429,427 A * 2/1969 Wolf ..... 206/214
3,703,326 A * 11/1972 Riviers ..... 312/348.3
4,375,263 A * 3/1983 Dworkin ..... 206/425
4,852,725 A * 8/1989 Folsom ..... 206/1.7
5,148,942 A * 9/1992 Snook ..... 220/533
5,636,743 A 6/1997 Dalbo

OTHER PUBLICATIONS www.beadcats.com, Oct. 09, 1999, Bags vs. Tubes vs. Hanks & Grams vs. Ounces.*

* cited by examiner

*Primary Examiner*—Mickey Yu
*Assistant Examiner*—Jerrold Johnson

(57) ABSTRACT

A container system for storing and presenting craft materials for organizing, ready access and inspection of the craft materials. The container system for storing and presenting craft materials includes a housing with a bottom wall and a perimeter wall extending upwardly form the bottom wall defining an interior space, and a plurality of lateral dividers positioned within the housing subdividing the interior space.

15 Claims, 1 Drawing Sheet

CONTAINER SYSTEM FOR STORING AND PRESENTING CRAFT MATERIALS

BACKGROUND OF THE INVENTION

1. Field of the Invention

The present invention relates to STORAGE CONTAINERS and more particularly pertains to a new container system for storing and presenting craft materials for organizing craft materials for ready access and inspection.

2. Description of the Prior Art

The use of STORAGE CONTAINERS is known in the prior art. Examples of such containers include U.S. Pat. No. 231,478; U.S. Pat. No. 3,249,392; and U.S. Pat. No. 5,636,743.

While these devices fulfill their respective, particular objectives and requirements, the need remains for a system that enhances the visibility and accessibility of the craft materials being stored.

SUMMARY OF THE INVENTION

The present invention meets the needs presented above by utilizing angles lateral supports to support containers of craft materials in an elevated position with an increased surface area available for viewing while the containers are positioned within the system.

Another advantage of the present invention is the transparent housing and lid, which allows for inspection of the craft materials being stored without the need to open the container.

Yet another advantage of the present invention is the optimized size for storing seventy-two 14 mm by 60 mm tubes of craft material.

To this end, the present invention generally comprises a housing with a bottom wall and a perimeter wall extending upwardly form the bottom wall defining an interior space, and a plurality of lateral dividers positioned within the housing subdividing the interior space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawing wherein.

DESCRIPTION OF THE PREFERRED EMBODIMENT

Figure 1:
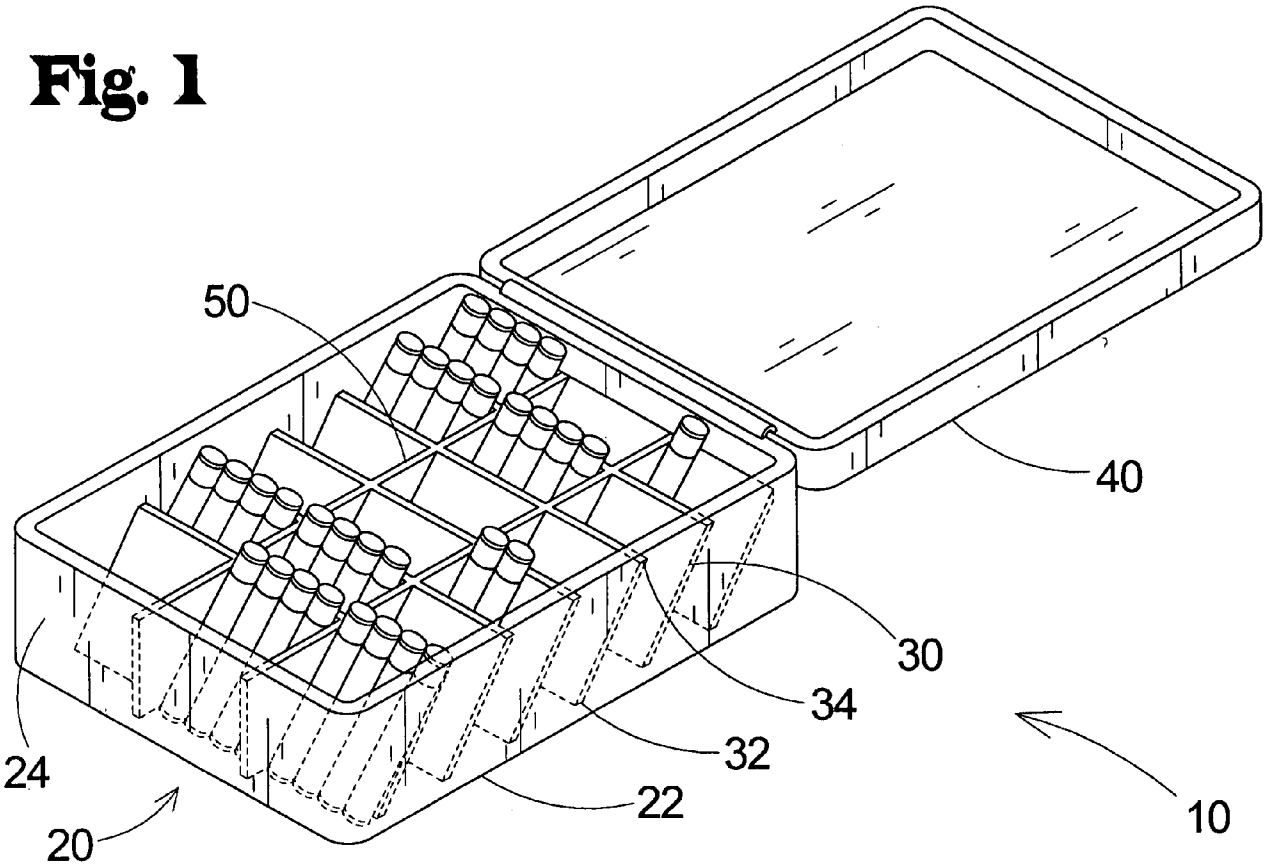
FIG. 1 is a schematic perspective view of a new container system for storing and presenting craft materials according to the present invention.

With reference now to the drawings, and in particular to FIG. 1 thereof, a new container system for storing and presenting craft materials embodying the principles and concepts of the present invention and generally designated by the reference numeral 10 will be described.

As best illustrated in FIG. 1, the container system for storing and presenting craft materials 10 generally comprises a housing 20 and a plurality of lateral dividers 30.

The housing 20 has a bottom wall 22 and a perimeter wall 24 extending upwardly form the bottom wall 22. The housing 20 defines an interior space.

Each one of the plurality of lateral dividers 30 is positioned within the housing 20. Preferably, each one of the lateral dividers 30 includes an angular bias. Thus a bottom edge 32 of each one of the lateral dividers 30 is positioned forward of a top edge 34 of the lateral divider 30. Each one of the lateral dividers 30 is for supporting a container of craft materials 2.

In a preferred embodiment, each one of the lateral dividers 30 has an angular bias of approximately 45 degrees from vertical.

A lid portion 40 may be included for selectively closing the housing 20. The lid portion 40 abuts a top edge of the perimeter wall 24 when the lid portion 40 is in a closed position.

At least one longitudinal divider 50 is operationally coupled to at least one of the plurality of lateral dividers 30. The longitudinal divider 50 subdivides the interior space. In the illustrative embodiment, the plurality of lateral dividers are substantially opaque.

In an embodiment the housing 20 is transparent to facilitate visual inspection of the craft materials positioned within the housing 20. The housing 20 may be made from a plastic material.

In a further embodiment the housing 20 is rectangular, with a length of approximately 12 inches, a width of approximately 8 inches, and a height of approximately 3 inches. The length, width, and height are selected for optimally storing up to seventy-two plastic bead containers 2 with a uniform size of 14 mm by 60 mm.

The lid portion 40 may be transparent to facilitate inspection of the craft materials positioned within the housing 20 when the lid portion 40 is in a closed position. Additionally, the lid portion 40 may be hingeably coupled to the housing 20.

In a further preferred embodiment, the plurality of lateral dividers 30 comprises seven lateral dividers 30 uniformly dispersed within the interior space, and a pair of longitudinal dividers 50 uniformly spaced within the interior space.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container system for storing and presenting craft materials for use, comprising:

a plurality of bead containers having a substantially uniform size of approximately 14 mm by approximately 60 mm:

a housing having a front and a rear, said housing comprising a bottom wall and a perimeter wall extending upwardly from said bottom wall, said housing defining an interior space;

a plurality of lateral dividers positioned in said housing, each one of said lateral dividers having an inclined orientation such that a bottom edge of each of said lateral dividers is positioned closer to the front of said housing and a top edge of each of said lateral dividers is positioned closer to the rear of said housing so that said divider walls are inclined away from a user positioned at the front of said housing during use, each of said lateral dividers being for supporting a bead container; and a lid pivotally mounted on said housing at the rear of said housing such that said lid pivots toward the front of said housing to close the interior space of said housing and pivots away from the front of said housing to expose said interior space, said lid having an open position characterized by said lid being located rearwardly of said housing;

wherein said housing and said lid are transparent to permit viewing of items positioned in said interior space when said lid is in a closed position;

wherein said housing is rectangular, said housing having a length of approximately 12 inches, said housing having a width of approximately 8 inches, said housing having a height of approximately 3 inches, said length, width, and height being selected for storing up to seventy-two plastic bead containers having a uniform size of approximately 14 mm by approximately 60 mm.

2. The system of claim 1, wherein said lid abuts a top edge of said perimeter wall when said lid is in the closed position.

3. The system of claim 1, wherein each one of said lateral dividers has an angular bias of approximately 45 degrees from vertical.

4. The system of claim 1, further comprising at least one longitudinal divider operationally coupled to at least one of said plurality of lateral dividers, said longitudinal divider subdividing said interior space.

5. The container system of claim 1, wherein the bead containers comprise substantially cylindrical vials for holding beads, each of said vials being positioned in one of a plurality of subcompartments in said interior space defined by said plurality of lateral divider walls, each of said vials being positioned in an inclined orientation.

6. The container system of claim 1, wherein said plurality of lateral dividers are substantially opaque.

7. The container system of claim 1, wherein said lid has a perimeter edge and said housing has a top edge, and wherein the perimeter edge of said lid and the top edge of said housing lie in substantially the same plane when said lid is in the open position.

8. The system of claim 1, additionally comprising at least one longitudinal divider mounted on at least one of said plurality of lateral dividers, said at least one longitudinal divider subdividing said interior space between said lateral dividers;

a plurality of substantially cylindrical vials for holding beads, each of said vials being positioned in one of a plurality of subcompartments in said interior space defined by said plurality of lateral divider walls, each of said vials being positioned in an inclined orientation;

wherein each one of said lateral dividers has an angular inclination of approximately 45 degrees from vertical;

wherein said plurality of lateral dividers are substantially opaque; and wherein said lid has a perimeter edge and said housing has a top edge, and wherein the perimeter edge of said lid and the top edge of said housing lie in substantially the same plane when said lid is in the open position.

9. The system of claim 8 wherein said plurality of lateral dividers comprises six lateral dividers, and wherein said at least one longitudinal divider comprises two longitudinal dividers.

10. A container system for storing and presenting craft materials for use, comprising:

a plurality of bead containers having a substantially uniform size of approximately 14 mm by approximately 60 mm;

a housing having a front and a rear, said housing comprising a bottom wall and a perimeter wall extending upwardly from said bottom wall, said housing defining an interior space;

a plurality of lateral dividers positioned within said housing, each one of said lateral dividers having an angular bias whereby a bottom edge of each one of said lateral dividers is positioned forward of a top edge of said lateral divider, each one of said lateral dividers being for supporting a bead container, each one of said lateral dividers had an angular bias of approximately 45 degrees from vertical;

a lid pivotally mounted on said housing at the rear of said housing such that said lid pivots toward the front of said housing to close the interior space of said housing and pivots away from the front of said housing to expose said interior space, said lid having an open position characterized by said lid being located rearwardly of said housing;

at least one longitudinal divider operationally coupled to at least one of said plurality of lateral dividers, said longitudinal divider subdividing said interior space;

wherein said housing is transparent to facilitate visual inspection of the craft materials positioned within the housing; and wherein said housing is rectangular, said housing having a length of approximately 12 inches, said housing having a width of approximately 8 inches, said housing having a height of approximately 3 inches, said length, width, and height being selected for storing up to seventy-two plastic bead containers having a uniform size of 14 mm by 60 mm.

11. The system of claim 10, wherein said lid portion is transparent to facilitate inspection of the craft materials positioned within said housing when said lid portion is in a closed position.

12. The system of claim 10, wherein said plurality of lateral dividers comprises six lateral dividers uniformly dispersed within said interior space, and wherein said at least one longitudinal divider comprises a pair of longitudinal dividers uniformly spaced within said interior space.

13. The system of claim 10, wherein said housing comprises plastic.

14. The system of claim 10, wherein said lid portion being hingeably coupled to said housing.

15. The system of claim 10, further comprising:

said lid portion is transparent to facilitate inspection of the craft materials positioned within said housing when said lid portion is in a closed position;

said plurality of lateral dividers comprises six lateral dividers uniformly dispersed within said interior space, and wherein said at least one longitudinal dividers comprises a pair of longitudinal dividers uniformly spaced within said interior space;

said housing comprises plastic; and said lid portion being hingeably coupled to said housing.

* * * * *